US008251780B2

(12) United States Patent
Ward et al.

(10) Patent No.: US 8,251,780 B2
(45) **Date of Patent: *Aug. 28, 2012**

(54) FLOOR GRINDING MACHINE AND GRINDING HEAD UNIT THEREFOR

(75) Inventors: Willis D. Ward, Independence, VA (US); Derrick L. Hamm, Sparta, NC (US); John E. Smith, Independence, VA (US)

(73) Assignee: Amano Pioneer Eclipse Corporation, Sparta, NC (US)

( * ) Notice: Subject to any disclaimer, the term of this patent is extended or adjusted under 35 U.S.C. 154(b) by 723 days.

This patent is subject to a terminal disclaimer.

(21) Appl. No.: 12/368,737

(22) Filed: Feb. 10, 2009

(65) Prior Publication Data

US 2010/0203813 A1 Aug. 12, 2010

(51) Int. Cl.
*B24B 23/00* (2006.01)

(52) U.S. Cl. ..... 451/353; 451/350; 451/270; 451/360

(58) Field of Classification Search ..... 451/350, 451/353, 270–271, 360–363, 359; 15/49.1, 15/98, 180, 87

See application file for complete search history.

(56) References Cited

U.S. PATENT DOCUMENTS

| | | | | | |
|---|---|---|---|---|---|
| 878,269 | A * | 2/1908 | Beck | 451/353 |
| 2,316,886 | A * | 4/1943 | Pascucci | 451/353 |
| 3,464,166 | A * | 9/1969 | Bouvier | 451/548 |
| 3,946,692 | A * | 3/1976 | Sierra et al. | 114/222 |
| 4,219,898 | A * | 9/1980 | Presby | 15/49.1 |
| 4,328,645 | A * | 5/1982 | Sauer | 451/359 |
| 4,907,313 | A * | 3/1990 | Roeker et al. | 15/98 |
| 5,081,734 | A * | 1/1992 | Sandford et al. | 15/93.1 |
| 5,944,586 | A * | 8/1999 | Sevigny et al. | 451/57 |
| 6,361,424 | B1 * | 3/2002 | Manor et al. | 451/490 |
| 6,523,214 | B1 * | 2/2003 | Kaiser | 15/230 |
| 6,887,133 | B1 * | 5/2005 | Halley | 451/41 |
| 7,094,140 | B2 * | 8/2006 | Palushi et al. | 451/548 |
| 7,517,411 | B2 * | 4/2009 | Hornsby et al. | 134/6 |
| 2006/0025059 | A1 * | 2/2006 | Gueorguiev et al. | 451/350 |
| 2010/0190421 | A1 * | 7/2010 | Hamm et al. | 451/353 |

* cited by examiner

*Primary Examiner* — George Nguyen
(74) *Attorney, Agent, or Firm* — Novak Druce + Quigg LLP

(57) ABSTRACT

A grinding head unit mountable in a planetary disk of a surface grinding machine generally including a housing mountable on the planetary disk, a holder supported on the housing and a surface grinding member detachably connectable to the holder wherein the holder is provided with a recess and the holder is provided with a portion receivable within such recess.

11 Claims, 3 Drawing Sheets

FLOOR GRINDING MACHINE AND GRINDING HEAD UNIT THEREFOR

FIELD OF THE INVENTION

This invention relates to a machine for grinding concrete, stone and other hard surfaces, a grinding head unit forming a component of such machine and a grinding disk forming a component of such head unit.

BACKGROUND OF THE INVENTION

In the prior art, there has been developed a machine for grinding concrete, stone and other like surfaces which generally consists of a motor mounted in a housing provided with a handle, a planetary disk mounted on an output shaft of such motor and a plurality of grinding head units mounted on the planetary disk and rotatable therewith. Typically, each of such head units is provided with a circular holder disk and a consumable, circular grinding disk detachably mountable on an underside of the holder disk. In such machines, the grinding disks may be replaced simply by manually detaching a worn disk and attaching a new disk. In doing so, it is advisable to mount the replacement disk concentrically on the holder disk. Otherwise, an eccentrically mounted replacement disk may adversely affect the operation of the machine, the attachment of the grinding disk to the holder disk, the effectiveness of the grinding disk and/or the condition of the surface being worked. In view of such possible misalignment of a consumable grinding disk during the replacement of a worn disk, it has been found to be desirable to provide for an improved arrangement for properly mounting replacement disks on the holder disks of such machines. Accordingly, it is the principal object of the present invention to provide for such an improved arrangement.

SUMMARY OF THE INVENTION

The principal object of the present invention is achieved by providing a surface grinding machine generally consisting of a drive means provided with an output shaft; a planetary disk mounted on such shaft; and at least one grinding head unit including a housing mounted on the planetary disk, a holder supported on the housing and a surface grinding member detachably mountable on the holder, provided with a grit surface, wherein the grinding member is provided with a recess and the holder member is provided with a portion receivable within such recess. In such arrangement, improved retention of the grinding member is provided. The relationship between the recess in the grinding member and the portion of the holder received in such recess assures that the grinding member will not become detached during operation. A grinding member with a mounting recess reduces the likelihood of the holder member contacting the floor. As the grit portion of the grinding member abrades away, the base portion thereof comes in contact with the floor. Under such circumstances, the grinding process ceases and the operator can detect the change. The operator can then replace the grinding member or members prior to the holder member contacting and damaging the floor.

DETAILED DESCRIPTION OF THE PREFERRED EMBODIMENT OF THE INVENTION

Figure 1:
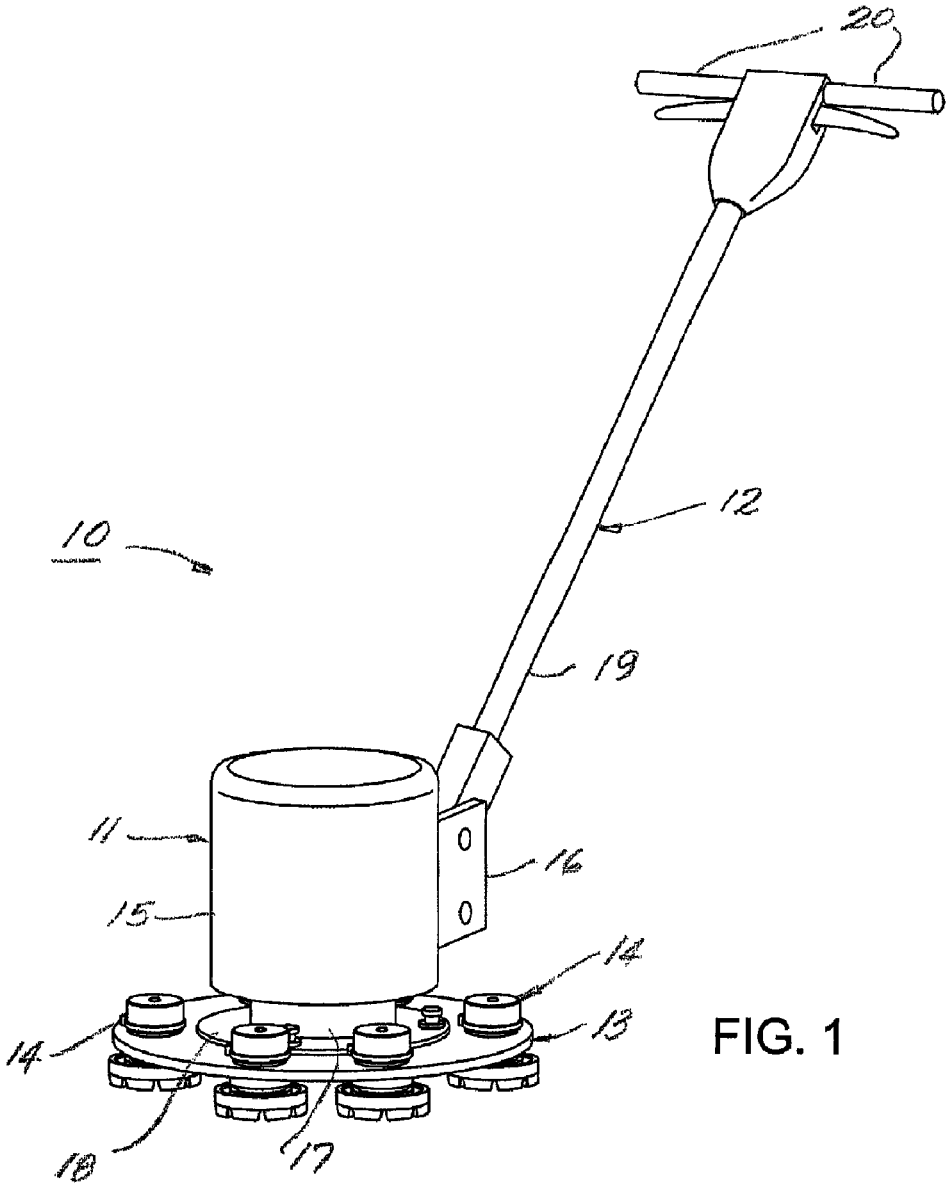
FIG. 1 is a perspective view of a floor grinding machine embodying the present invention.
Figure 2:
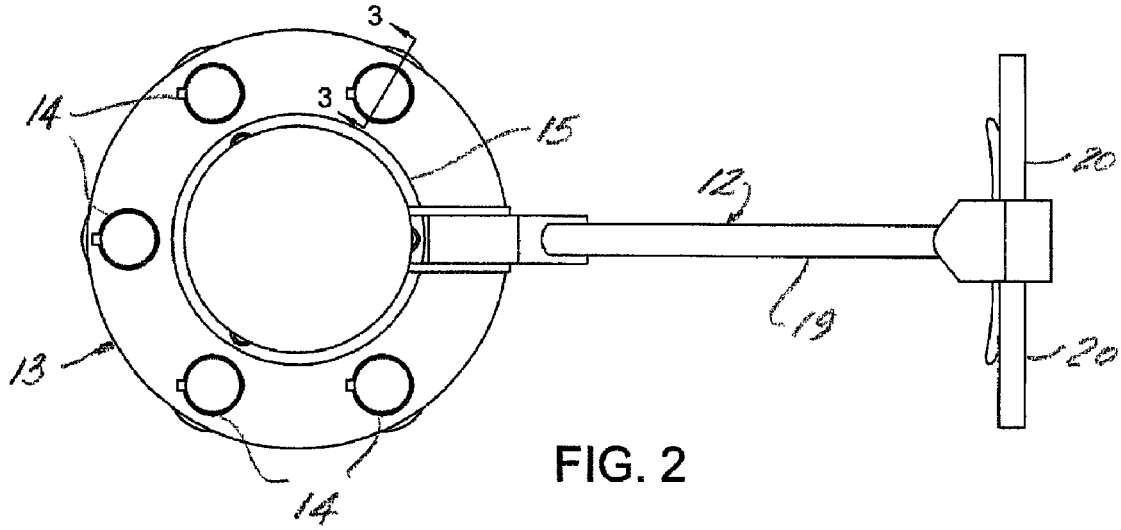
FIG. 2 is a top plan view of the machine shown in FIG. 1.
Figure 3:
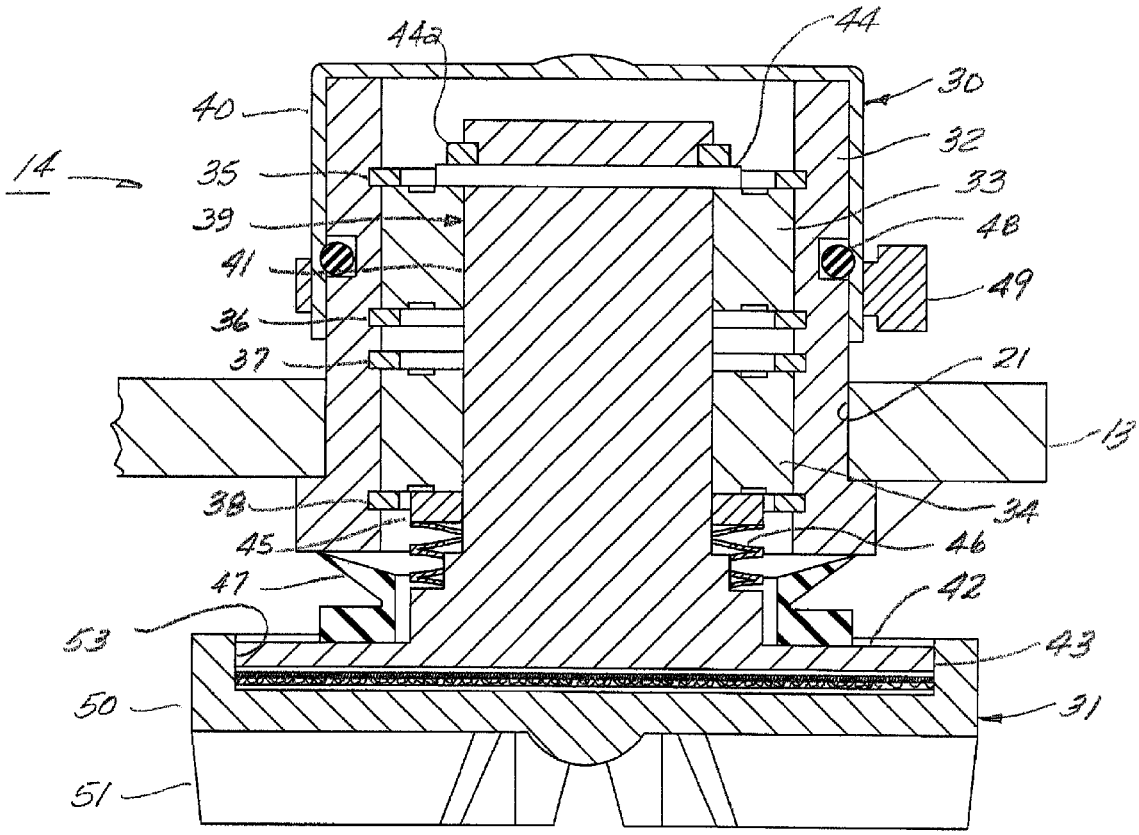
FIG. 3 is an enlarged cross-sectional view taken along line 3-3 in FIG. 2.

Referring to FIGS. 1 through 4 of the drawings, there is illustrated a floor grinding machine 10 embodying the present invention which generally includes a motor assembly 11, a handle assembly 12, a planetary disk 13 and plurality of grinding head units 14. Motor assembly 11 includes a motor mounted within a housing 15 provided with a set of brackets 16, 16, having a depending output shaft. Mounted on the free end of the output shaft is a carrier number 17 provided with an annular flange 18. Handle assembly 12 includes an elongated member 19 having a lower end thereof received within and pivotally connected to brackets 16, 16, and a pair of handles 20, 20 disposed at an upper, free end thereof which may be gripped by an operator to guide the machine over a floor surface. The motor of the machine may be either an internal combustion engine or an electric motor and may be operated in the conventional manner with controls mounted on the handle assembly adjacent handles 20, 20. Planetary disk 13 is detachably mounted on the underside of flange portion 18 of carrier number 17 for rotational movement therewith as the motor is operated. As best seen in FIGS. 2 and 3, the planetary disk is provided with plurality of circumferentially spaced, circular openings 21 in which there is mounted a set of grinding head units 14.

Figure 4:
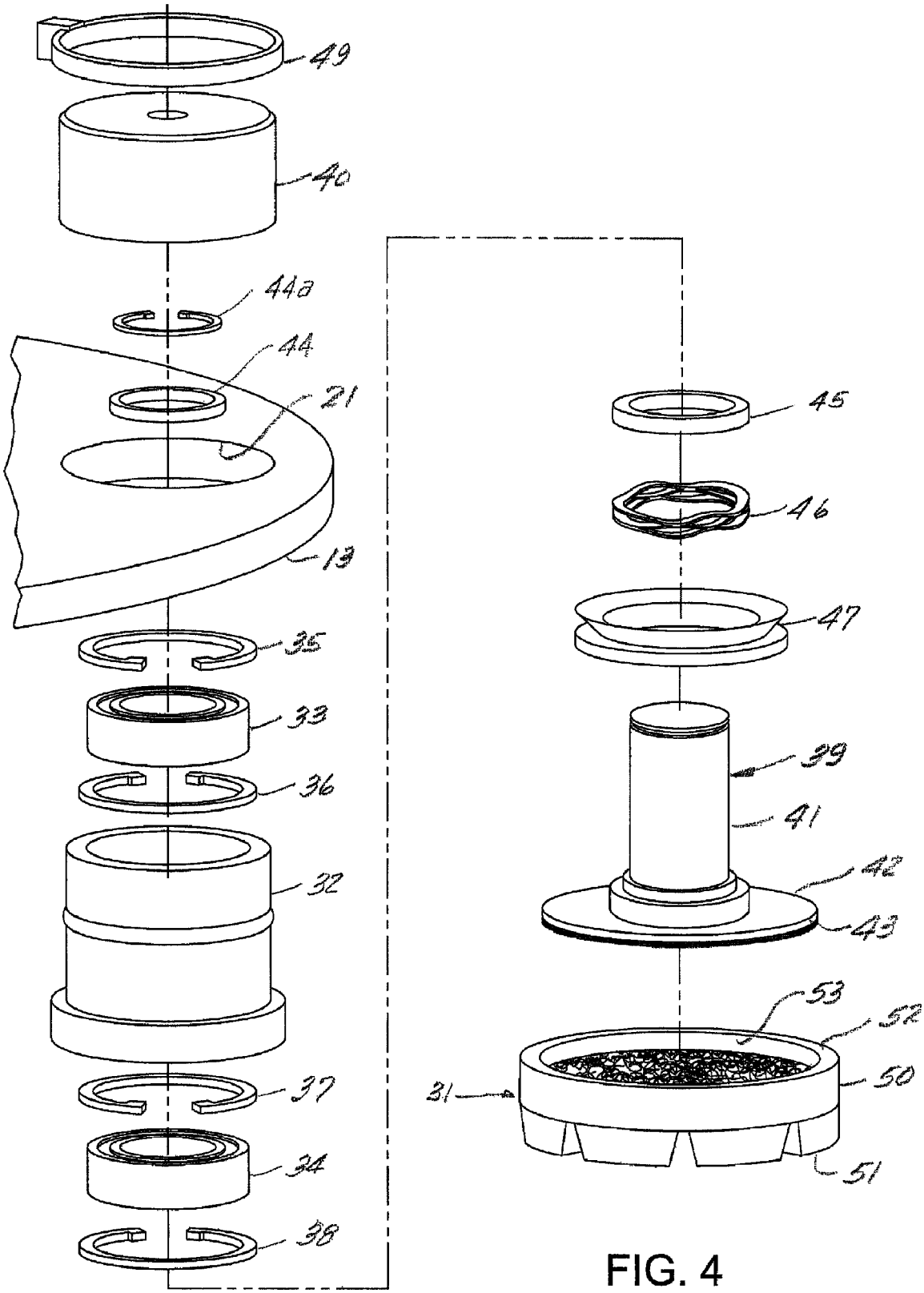
FIG. 4 is a perspective, exploded view of the unit shown in FIG. 3.

As best seen in FIGS. 3 and 4, each grinding head unit 14 includes a base assembly 30 on which a grit disk 31 may be detachably connected. Base assembly 30 includes a cylindrical housing 32 disposed in an opening 21 and rigidly secured to planetary disk 13, a pair of bearings 33 and 34 mounted in housing 32, retained by a set of split retainers 35-38, a holder member 39 and a cap member 40 closing the upper end of the housing. Holder member 39 includes a shaft portion 41 journaled in bearings 33 and 34 and an integrally formed, annular flange portion 42 provided with an annular sidewall 43 and a bottom circular surface. The upper end of shaft portion 41 is provided with an annular member 44 seated on bearing 33 and a split ring retainer **44*a* disposed in an annular groove in the shaft portion and engageable with the upper side of annular member 44, permitting the holder member to displace upwardly but restricting displacement downwardly. The lower end of shaft portion 41 is provided with an annular member 45 engageable with bearing 34 and an annular wave spring 46 interposed between the flange portion of the holder member and annular member 45. Spring 46 functions to bias the holder member downwardly and permits upward displacement of the holder member relative to housing 32. An annular seal 47 is disposed about the lower end of shaft portion 41, interposed between the lower end of housing 32 and flange portion 42, an o-ring 48 is disposed between housing 32 and cap member 40 to seal the interior of the housing from the exterior, and an elastic fastener band 49** is provided to secure the cap member on the housing.

Grit disk 31 is adapted to be detachably mounted on the bottom end of flange portion 43, and includes a base portion 50 and an integral grit portion 51. An upper surface 52 of base portion 50 is provided with a circular recess 53 having a diameter equal to or slightly greater than the diameter of flange portion 42 of the holder member to permit flange portion 42 of the holder member to the received in recess 53 when the grit disk is mounted on the lower end of the holder member as shown in FIG. 3. The bottom surface of flange portion 42 of the holder member and the bottom surface of recess 53 of the grit disk are provided with hook and loop laminates which allows grit member 31 to be detachably connected to the lower end of the holder member when grit member 31 is mounted on the bottom of flange portion 42 and such materials engage, as shown in FIG. 3.

Each of the grinding head units as described may be mounted and assembled in an opening 21 of planetary disk 13 by first inserting the housing thereof in an opening 21 of the planetary disk, and securing such housing therein by welding or any other suitable means. The retainer rings and bearings are then inserted in the mounted housing so that the bearings are axially aligned and spaced within the housing. The annular wave spring and associated spacer and seal are then positioned on the shaft portion of a holding member, supported on the lower flange portion, and the upper end of the shaft is inserted into the bearings within the housing. The shaft portion is secured within the bearings by means of annular member 44 and retainer ring 44*a*. Seal 48 is then mounted, the cap is mounted on the upper end of the housing to close the upper end of the housing and the elastic fastener is applied to secure the cap on the housing. Grinding member 31 is attached to holder member 39 by axially aligning recess 53 of base portion 50 of the grit disk with flange portion 42 of the holder member and axially displacing it to cause such flange portion to be received in recess 53 and mate hook and loop surfaces.

The complimentary configurations of the circular recess in the grinding member and the insertable circular portion of the holder member not only facilitates the attachment of the grinding member to the holder member but concentrically aligns the grinding member with the flange portion of the holder member to assure a proper attachment and function of the grinding member. The design further provides for better radial retention during operation and reduces the probability of the holder member from coming in contact with the floor.

In replacing a worn disk 31, the exposed portion of the grinding member simply may be gripped and pulled away.

Although the use of a complimentary circular recess and insertable portion arrangement is preferable in terms of ease of application and proper alignment, it is possible to achieve some benefits of the invention in the use of other complimentary recess and insert arrangements, namely arrangements providing complimentary polygonal cross-sectional configurations. Although such complimentary configurations would provide suitable alignment of the grit disk and the flange portion of the holder member, they would have the disadvantage of possibly requiring angular adjustment to properly align the mating surfaces.

The proper alignment of the grinding member with the associated holder member not only facilitates the replacement of the disk and secures it effectively to the holder member but assures the proper operation of the machine, maximum use of the disk and the grinding of a smooth floor surface.

The relationship between the aforementioned complimentary recess and insert arrangement better retains the grinding member during operation. The meshing hook and loop surfaces serve to retain the grinding member axially, but the recess in the grinding member retains the grinding member radially. A grinding member with a mounting recess reduces the likelihood of the holder contacting and damaging the floor. As the grit portion of the grinding member abrades away, the base portion of the grinding member contacts the floor. When this occurs, the grinding process has stopped, but the floor is not damaged. The operator is able to determine a discernable difference in performance and can replace the worn grinding member or members.

The machine as described can be used to grind any hard surface floor including floors formed of concrete, stone, marble, terrazzo, granite and similar materials. It may be driven by an internal combustion engine, an electric motor or a battery driven motor.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

What is claimed is:

1. A surface grinding machine, comprising:

a drive means provided with an output shaft;

a planetary disk mounted in said output shaft; and at least two grinding head units each including a housing mounted on said planetary disk, a shaft having a flange portion, journaled in said unit housing, resilient means interposed between said unit housing and said flange portion of said unit shaft, biasing said flange portion outwardly relative to said unit housing, and a surface grinding member detachably connected to said flange portion provided with a grit surface, wherein said grinding member is provided with a recess and said flange portion of said unit shaft is provided with a portion receivable within said recess.

2. A machine according to claim 1 wherein the configurations of said recess and said receivable portion are complimentary.

3. A machine according to claim 2 wherein said configurations include mating annular surfaces.

4. A machine according to claim 1 wherein said drive means is disposed in a housing, and including a handle mounted on said housing.

5. A machine according to claim 1 wherein said planetary disk is disposed in a plane disposed perpendicular to the axis of said output shaft, and including at least two of said grinding head units spaced circumferentially relative to said axis.

6. A machine according to claim 1 wherein the housing of each of said grinding head units is rigidly mounted on said planetary disk.

7. A machine according to claim 1 wherein each of said grinding head units is detachably connected to said flange portion by means of mating hook and loop surfaces.

8. A grinding head unit mountable in a planetary disk of a surface grinding machine, comprising:

a housing mountable on said planetary disk, a shaft having a flange portion, journaled in said housing;

resilient means interposed between said unit housing and said flange portion, biasing said flange portion to displace said flange portion relative to said unit housing; and a surface grinding member detachably connectable to said flange portion wherein said grinding member is provided with a recess and said flange portion is provided with a segment receivable within said recess.

9. A unit according to claim 8 wherein the configurations of said recess and said receivable portion are complimentary.

10. A unit according to claim 9 wherein said configurations include mating circular surfaces.

11. A unit according to claim 8 including mating hook and loop surfaces for detachably connecting said grinding member to said holder flange portion.

* * * * *